United States Patent [19]

Poundstone et al.

[11] 3,993,146

[45] Nov. 23, 1976

[54] APPARATUS FOR MINING COAL USING VERTICAL BORE HOLE AND FLUID

[75] Inventors: William N. Poundstone, Pittsburgh, Pa.; William J. Miller, Ponca City, Okla.

[73] Assignee: Continental Oil Company, Ponca City, Okla.

[22] Filed: Aug. 26, 1974

[21] Appl. No.: 500,425

Related U.S. Application Data

[62] Division of Ser. No. 392,576, Aug. 29, 1973, Pat. No. 3,824,733.

[52] U.S. Cl. ..... 175/206; 175/209; 175/213

[51] Int. Cl.[2] ..... E21B 21/00

[58] Field of Search ..... 175/67, 206, 209, 210, 175/215, 267, 269, 422, 230; 299/17, 18

[56] References Cited

UNITED STATES PATENTS

| | | | |
|---|---|---|---|
| 2,941,783 | 6/1960 | Stinson | 175/210 X |
| 3,599,733 | 8/1971 | Varley | 175/67 X |

FOREIGN PATENTS OR APPLICATIONS

| | | | |
|---|---|---|---|
| 623,051 | 7/1961 | Canada | 175/267 |
| 1,634,586 | 8/1970 | Germany | 175/230 |

*Primary Examiner*—Ernest R. Purser
*Attorney, Agent, or Firm*—William J. Miller

[57] ABSTRACT

Coal can be mined from a substantially vertical or steeply inclined seam by forming a cavity in the seam and filling the cavity with a magnetite slurry having a specific gravity greater than the coal being mined therefrom.

As the coal is dislodged, it will float to the top and be pumped from the cavity by the excess magnetite slurry being supplied to the cavity. A coal-magnetite slurry separator is used to separate the coal from the magnetite slurry, whereupon the magnetite slurry is reinjected into the cavity.

9 Claims, 6 Drawing Figures

APPARATUS FOR MINING COAL USING VERTICAL BORE HOLE AND FLUID

This is a division, of application Ser. No. 392,576, filed Aug. 29, 1973 and now U.S. Pat. No. 3,824.733.

DISCUSSION OF THE PRIOR ART

Vertical seams have generally been mined in the past by use of strip mining; however, strip mining can only be economically performed for fairly shallow penetrations into the coal seam, since a vast amount of debris and rock must be removed in order to reach any depth in the coal seam. Strip mining is only feasible when the coal seam has a substantial width and fairly high grade.

A forming of mining known as cut-and-fill stopping is also used for substantially vertical seams and is accomplished by digging a tunnel along the seam forming ore chutes above the tunnel and mining out the coal, dropping it into the ore chutes and thence into the cars positioned below said chutes; however, where the seams may be badly folded, it may be extremely difficult to mine the same from underneath.

Another method of mining vertical seams can be used, such as the shrinkage stoppage method. The particular method used will depend on the competency of the hanging wall, the particular form of the seam, whether the ore is weak or strong, and other well known factors.

BRIEF DESCRIPTION OF THE INVENTION

This invention describes a method for mining substantially vertical seams by forming a cavity in the seam, either from the top or from a desired depth, filling the cavity with magnetite slurry which has a specific gravity greater than the specific gravity of the coal, and then dislodging the coal mechanically wherein the coal will float to the surface and be pumped from the cavity by the excess magnetite slurry being supplied thereto.

Separators are used to separate the coal which is conveyed from the separator from the slurry which is pumped back into the cavity along with additional magnetite, if needed, to maintain specific gravity above that of the coal. In one embodiment the cavity is formed from the surface and is acceptable for high grade coal where the amount of impurities in the coal is minor compared to the tonnage of coal mined. Under ordinary conditions, however, debris and unusable materials can amount to as much as 20 percent of the coal mined. The preferred embodiment overcomes the accumulation of debris by drilling a bore hole to a desired depth in the coal seam, anchoring a magnetite recovery pipe at the bottom of the bore hole, and mounting a mechanical dislodging apparatus around the magnetite recovery pipe. Magnetite slurry is pumped down the dislodging device and against the mine surface. Mechanical devices, such as picks, will dislodge the coal which is flushed away by the magnetite being jetted against the coal surface. As the coal is dislodged, the apparatus is pulled up in the manner of raise drilling. The dislodged coal floats to the surface because of its lower specific gravity and is conveyed through a pipe or trench to a magnetite slurry-coal separator. When the cavity reaches the surface of the earth, the dislodging apparatus is removed. Fresh water is pumped into the cavity, and the magnetite slurry is removed by back-flushing the fresh water through the debris and into the magnetite recovery pipe where it is pumped from the cavity.

In the above manner most of the magnetite can be recovered from the cavity. The magnetite slurry being recovered will be applied to a magnetite-water separator. The water will be returned to the mine cavity, and the recovered magnetite will be applied to the new cavity being mined.

BRIEF DESCRIPTION OF THE FIGURES

Referring to FIGS. 1 through 3, the preferred embodiment is illustrated.

Figures 1, 1A:
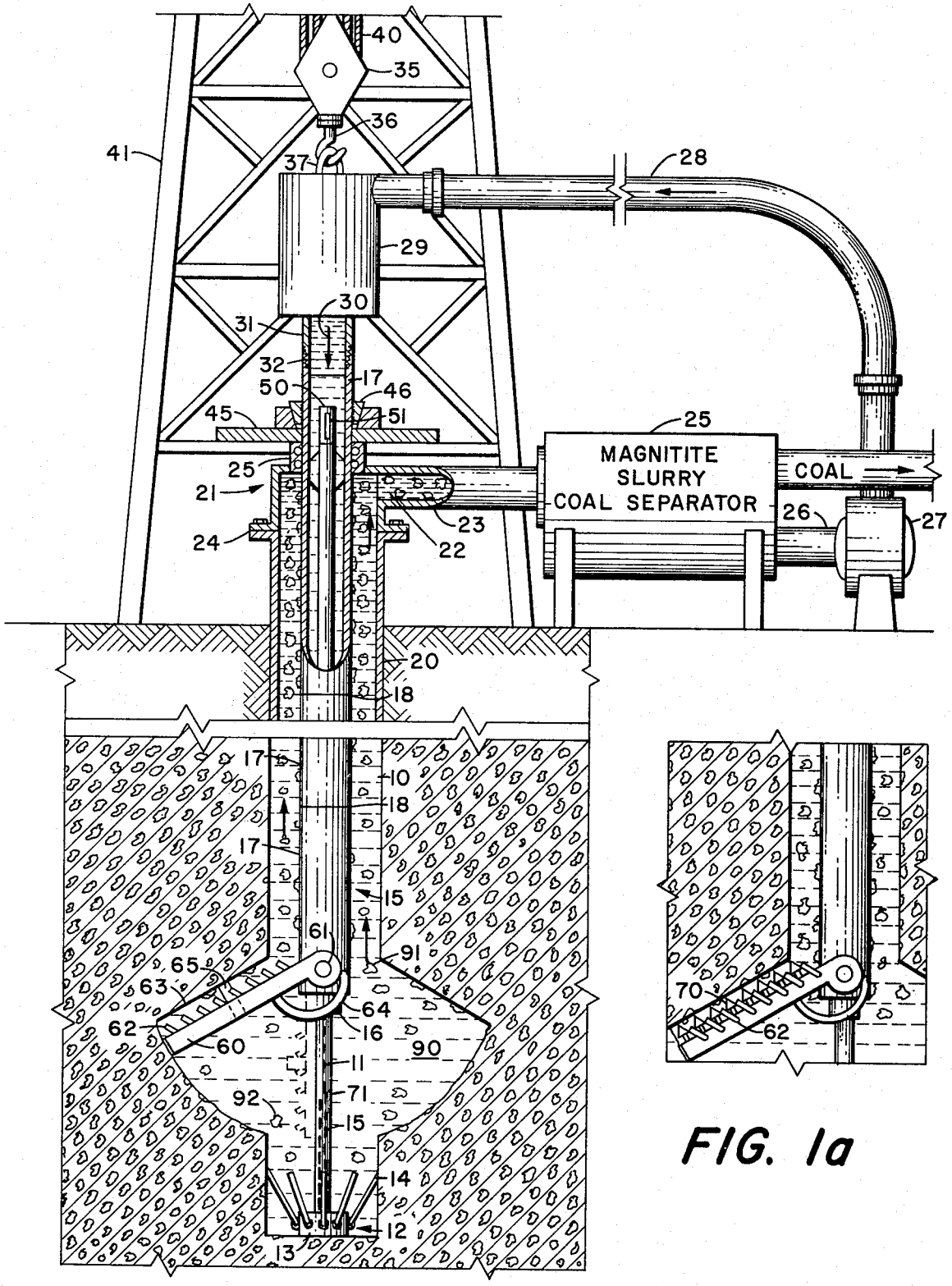
FIG. 1 is a cross-sectional view of a cavity being formed using the raise drilling principle.
FIG. 1*a* is an alternate embodiment of the dislodging arm shown in FIG. 1.

A bore hole 10 is formed in the seam to a desired depth which may, for example, be from 700 to 900 feet in depth. A magnetite recovery pipe 11 (to be later described) is inserted axially into the bore hole. An anchoring means 12 is attached to the bottom of magnetite recovery pipe 11 and comprises a ring 13 and a plurality of extending rods 14. A plurality of openings 15 perforates the lower end of recovery pipe 11. These openings may be slots or circular in shape and may be plugged to prevent entry of debris, by any means such as wax or plastic which can be removed at a later time. The type of slots used and the plugging material, if used, are well known in the art and will not be further described herein.

A dislodging pipe 15 is slipped axially over recovery pipe 11 and has a rotatable seal 16 at its lower end. Dislodging pipe 15 may be formed from a plurality of sections 17 joined at 18 by a threaded joint. It is preferable that the outer circumference of the pipe be completely uniform across the joint.

Bore hole 10 has a surface seal formed by a pipe 20 forced into or cemented into bore hole 10. Pipe 20 terminates in a pipe end 21, bolted by means of a flange 24 to surface seal pipe 20. Pipe end 21 has a seal 25 which provides a fluid tight seal for dislodging pipe 15 and yet permits rotation of pipe 15. Pipe end 21 also has an outlet 22 which is connected through a pipe 23 to a magnetite slurry-coal separator 25. The magnetite slurry-coal separator basically incorporates a conveyer which removes the coal floating on the surface of the magnetite and deposits the coal in a dump or other location and returns the magnetite to the mine cavity. Such magnetite slurry-coal separators are described on page 9–26 through page 9–35 in a book entitled "Coal Preparation," Third Edition, by Joseph W. Leonard and David R. Mitchell and published through The American Institute of Mining, Metallurgical, and Petroleum Engineers, Inc., and published by the Port City Pres, Inc., Baltimore, Md. The magnetite slurry is returned through a line 26 to a pump 27 to injection line 28 to a hydraulic motor 29 and to the inside of dislodging pipe 15 in the direction of arrow 30. As the magnetite slurry is forced through hydraulic motor 29, it causes rotation of a shaft 31 which is connected through threads 32 to a pipe section 17 of dislodging pipe 15. Hydraulic motor 29 is held in place or moved by means of a hoist 35 which contains a hook 36 interlocked with an eye 37 which is permanently attached to the hydraulic motor 29. A plurality of lines 40 is connected to a hoist pulley (not shown). The entire structure is supported by a rig 41 which is attached by any suitable means, either portable or permanent, to the surface of the earth.

A pipe clamping means is attached through a flange 45 to pipe end 21. A wedge-type pipe retaining means 46 is mounted onto flange 45. Wedge retaining means 46 permits upward movement and rotational movement of dislodging pipe 15 but will prevent pipe 15 from moving downwardly into the cavity.

The upper end 50 of magnetite recovery pipe 11 contains a small slot 51 which permits entry of magnetite slurry into pipe 11 but restricts the loss in pressure so that the majority of the pressure is available at the bottom of dislodging pipe 15.

A dislodging arm 60 is attached through a pivot 61 to the bottom end of dislodging pipe 15. A plurality of jets 62 is mounted on dislodging arm 60 and directed upwardly so as to create a high velocity fluid stream against the mine surface 63. A flexible pipe 64 communicates fluid from the inside of dislodging pipe 15 to the jets 62. A roller 65 maintains a precise distance between the jets and mining surface 63. A suitable mechanical lock (not shown) maintains dislodging arm 60 in a rigid position once the arm has moved to the proper cutting position.

Referring to FIG. 1*a*, an alternate embodiment of the dislodging arm is shown and essentially comprises a plurality of picks 70 attached between jets 62. In this embodiment the jets principally provide means for removing the dislodging chips of coal and debris rather than provide a means for removing the coal by high velocity of fluid.

Mining Operation

The operation of the preferred embodiment is as follows:

The dislodging pipe 15 and dislodging arm 60 are lowered into bore hole 10 with the dislodging arm in the position shown by dotted lines 71. The mechanical locks maintaining dislodging arm in the position shown by dots 71 can be released by any well known method such as a mechanical pin, an electrical squib, or other well known triggering devices. Once the dislodging arm 60 is released, pump 27 initiates the pumping of magnetite slurry into hydraulic motor 29, down the inside of pipe 15 in the direction of arrow 30 through flexible tube 64 to jets 62. Hydraulic motor 29 will begin rotating as soon as the flow through the motor becomes sufficient to generate enough horsepower to operate the hydraulic motor. As motor 29 begins to rotate, dislodging pipe 15 begins to rotate, causing dislodging arm 60 to rotate about the wall of the bore hole. The high pressure from the jets 62 begins eroding the bore hole wall from cavity 90. The jet fluids will also commence filling up cavity 90 and the bore hole 10 with fluid or magnetite slurry. Once the bore hole is filled, slurry will flow down through outlet 22, down pipe 23, to magnetite slurry, the coal separator 25 for recirculation through pipe 36 to pump 37. The coal 91, fore example, will be dislodged and proceeds to the surface, since it has a specific gravity less than that of the magnetite slurry. Debris 92, for example, will fall to the bottom of the well bore and cavity 90. Roller 65 will maintain the distance between the mining surface 63 and jets 62; or, if picks are used, the picks 70 (see FIGS. 1*a*) will maintain contact with mining surfaces 63 eroding the mining surface.

Seal 16 permits rotation of dislodging pipe 15 with respect to magnetite recovery pipe 11 and yet retains the fluid pressure inside pipe 15. Anchor 12 retains magnetite recovery pipe down-hole and in position during the rotation and lifting of dislodging pipe 15. Metal rods 14 are spring biased away from the outside wall of pipe 11 and have sufficient diameter to engage the bore hole wall. Thus, if pipe 11 rises, rods 14 wil dig into bore hole wall 11, retaining the pipe into position.

The particular anchor disclosed here should properly hold the recovery pipe 11 in position; however, other types of anchors could be used, for example, an inflatable packer, auger, and other well known apparatus for securing a pipe in a particular location. It is preferable, of course, that the particular anchor used be releasable at a later time so that the pipe can be recovered after the recovery operation is complete.

As dislodging arm 60 rotates the coal will soon be eroded to the point where either the picks or jets can no longer remove any coal. At this point hoist 25 and its associated equipment will raise the hydraulic motor 29 through hook 36 and eye 37, lifting pipe 15. Since dislodging arm 60 is connected to pipe 15 it will likewise rise with the pipe, thereby permitting dislodging arm to re-engage the mining surface 63. As a section of pipe 17 is raised to the point where a joint 18 is above wedge clamp 46, the hoist 35 will be lowered, wedging the pipe of the clamp 46. Hydraulic motor 29 will then be reversed or mechanically unscrewed from pipe 17 and that section of pipe removed. Motor 29 will then be connected with the next lower section 17 of pipe 15. The procedure will be followed until the dislodging arm 60 has cut away mining surface 63 in a nearly cylindrical form to a depth near the surface of the ground which will under normal conditions be the bottom of surface seal 20. At this time pipe end 21, including wedge clamp 46, will be removed along the hydraulic motor 29, and the magnetite recovery process will commence.

Magnetite Recovery

Figures 2, 3:
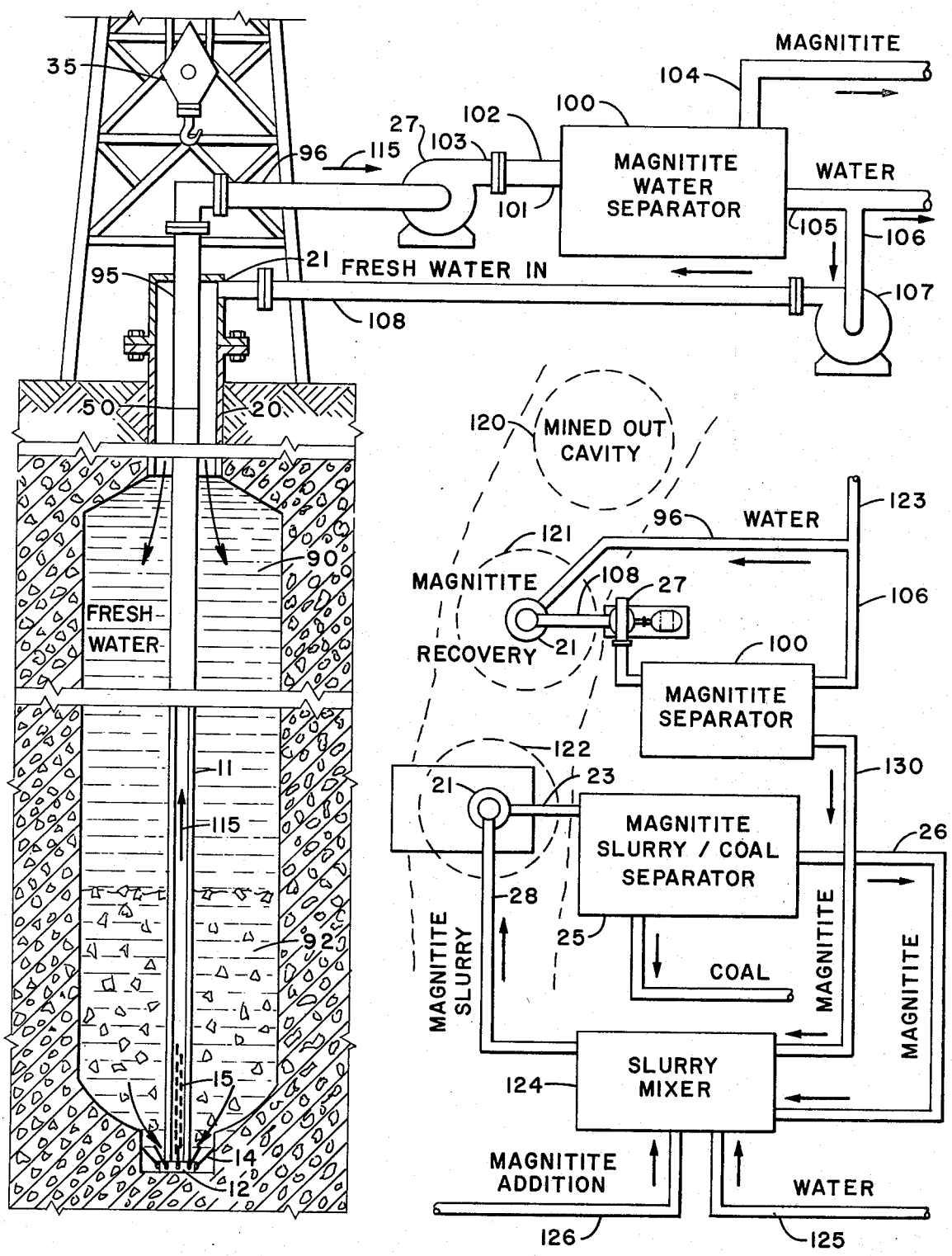
FIG. 2 is a cross-sectional view of a mined cavity illustrating the magnetite recovery process.
FIG. 3 is a top view of a mining operation illustrating the process of recovering the magnetite from a mined cavity, mining a new cavity, and supplying the recovered magnetite to the cavity being mined.

Referring to FIGS. 2 and 3, but in particular to FIG. 2, a completely formed cavity 90 is illustrated having magnetite recovery pipe 11 therein anchored at the bottom by anchor means 12. Pipe end 21 has an extension pipe 95 passing therethrough and connected to the end 50 of pipe 11. The short portion containing slot 51 has been removed. Pipes 96 are connected from extension 95 to the inlet of pump 27. A magnetite water separator 100 has its inlet 101 connected through pipe 102 to the outlet 103 of pump 27. The reclaimed magnetite is recovered through outlet 104 and the water is recovered through outlet 105. Water from outlet 105 is connected through a line 106 to a second pump 107 to the water inlet 108 of pipe end 21.

Operation

The importance of recovering magnetite in the cavity and debris cannot be minimized. It is estimated that in a cavity of approximately 700 feet in height and a radius of three feet, approximately 1,000 tons of mined material can be recovered. Assuming 20 percent of the material is debris and 80 percent of the material is coal, approximately 800 tons of coal will be recovered and 200 tons of debris will lie in the bottom of the cavity. Assuming the debris will not be firmly compacted, it will fill from one-fourth to one-third of the cavity. Magnetite has a specific gravity of 5.0. Assuming a good grade of magnetite, approximately 90 percent of the magnetite will be finer than sixe 360. A certain portion of the magnetite will settle to the bottom of the cavity during the mining process particularly since the magnetite is in the form of a slurry and not in the form of a solution. If, for example, 100 tons of magnetite settled with the debris to the bottom of the cavity, over $2,000 worth of magnetite would be lost if no method of recovery were possible. In order to recover the magnetite, therefor improving the economics of this form of mining, fresh water is pumped through pump 107 to inlet 108 into the cavity 90. The fresh water will cause backflooding of the debris; and, since magnetite is the heaviest material in the cavity, it will settle to the bottom near the openings 15 of pipe 11. Pump 27 will then suck up the fresh water and magnetite through holes 15 up pipe 11 in the direction of arrow 115 and through pipe 96 to pump 27 where it is moved through pipes 102 and 101 to magnetite water separator 100. Magnetite water separators are well known in the art. Such devices are clearly described in the book "Coal Preparation," (supra). The reclaimed magnetite is saved for further mining operations, and the water is returned through lines 106 to pump 107 (if needed) and thence to cavity 90. Once the amount of magnetite being recovered is insufficient for the energy being expended to recover it, the magnetite recovery process is discontinued. Pipe 96 is removed along with pipe end 21. Pipe section 95 is connected to hoist 35, and the entire pipe 11 lifted out of the cavity 90. Anchor 12 will disengage by either tearing away the walls of the bore hole portion remaining or, rods 14 will bend or break off as pipe is pulled up through the debris.

The above system has certain advantages. For example, it does permit a means of recovering a high cost item such as the magnetite used in mining the ore; and it does permit recovery of the magnetite recovery pipe. Since the pipe was put in initially, no hole need be drilled at a later time through unconsolidated debris which would pose a difficult drilling problem under the best of conditions.

Mining System

Referring to FIG. 3 the entire mining system is disclosed showing the process for mining a narrow vertical seam. A mined out cavity 120 is followed by a mined out cavity 121 where magnetite recovery is in process and a partially mined out cavity 122 where mining is still in progress. In the recovery cavity 121, pipe 96 is applying water through pipe end 21 to cavity 121, and pipe 108 is pumping out the magnetite slurry through pump 27 to magnetite water separator 100. The water is being returned through line 106 to pipe 96 and back to cavity 121. Additionally water, if needed, is added through line 123. The mining section has the magnetite slurry being applied through line 28 into pipe end 21 and the magnetite slurry and coal being recovered throuugh pipe 23 to magnetite slurry and coal separator 25. The magnetite once separated is applied through line 26 to a slurry mixer 24 where water 125 and magnetite 126 are being added by amounts to insure the proper specific gravity of the magnetite. Once the slurry mixture is proper, it is returned through line 28 to the cavity 122. Magnetite being recovered from separator 100 is transferred by conveyer or line 130 to the slurry mixer 124.

The separator 100, the slurry-coal separator 125, the slurry mixer 124, pump 27 and any other necessary pumping and power equipment can be mounted on a single or plurality of vehicles in order to provide mobility to the system.

Surface Cavity Mining

Figure 4:
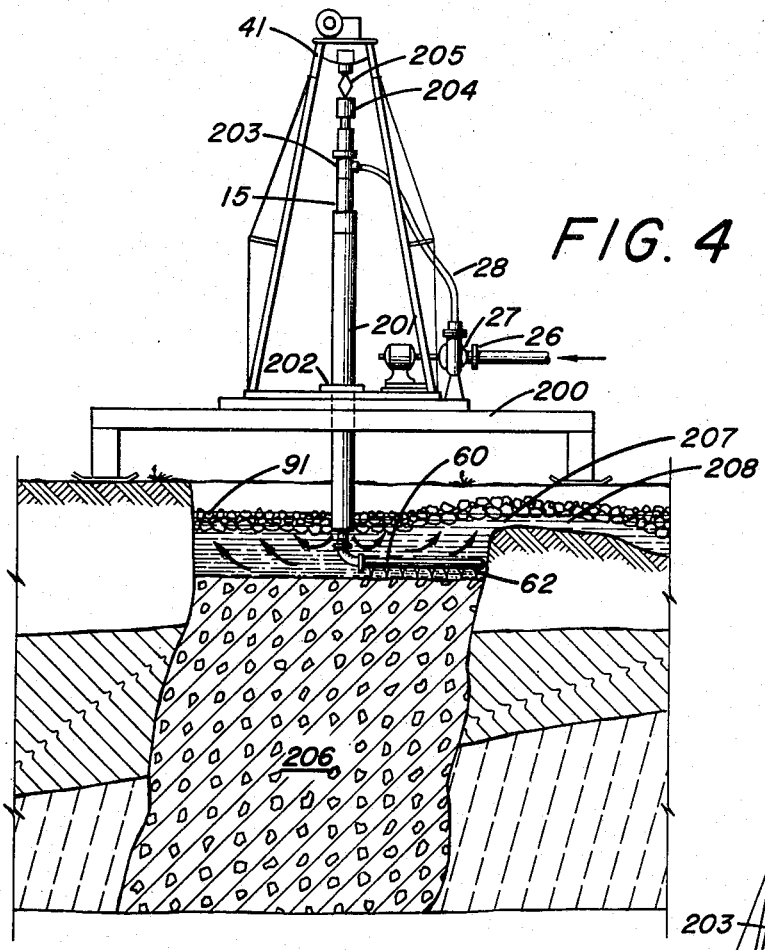
FIGS. 4 and 5 illustrate the method of mining a substantially vertical seam by forming the cavity from the surface of the earth.
Figure 5:
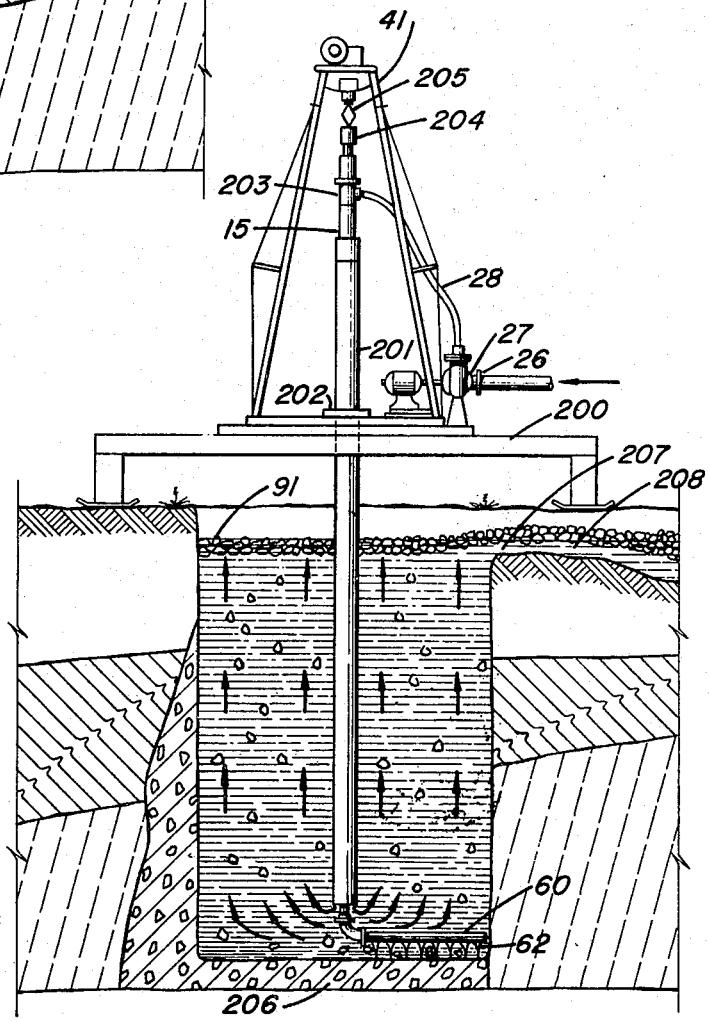

Referring to FIGS. 4 and 5, a surface cavity mining system is illustrated. A platform 200 has an outer casing 201 rotatably attached by a bearing 202 to platform 200. Dislodging pipe 15 is mounted inside casing 201. Pump 27 has an inlet 26 connected to a source of magnetite slurry (not shown). The outlet from pump 27 is connected through pipe 28 to a rotatable pipe connected 203. A motor 204 is connected through a winch 205 to rig 41. Motor 204 can be electric or hydraulic of sufficient power to turn dislodging pipe 15 and dislodging arm 60. Jets 62, which, as previously described, can also be picks such as 70 in FIG. 1*a*, are in engagement with coal seam 206.

Operation

The operation of the dislodging arm 60 shown in FIGS. 4 and 5 is substantially identical to the operation of the dislodging arm 60 described in FIG. 1 through 3. Magnetite slurry 207 fills the cavity and overflows through a trench 208 to a recovery area (not shown). Coal 91 floats on the magnetite slurry and can be easily removed. The system described in FIGS. 4 and 5 is extremely useful for very high grades of coal with little debris embedded in it. Obviously, as the debris accumulates, the mining must be stopped and the debris mechanically removed before mining can be recommenced.

Magnetite Slurry

Coal of a high grade anthracite normally has a specific gravity of from 1.4 to 1.7. The density of the magnetite must be greater than the density being mined in order for the coal to float; threfore, if the density of the coal is 1.4, the density of the magnetite must be at least 1.5 in order for the magnetite to have adequate buoyancy. Bituminous coal normally ranges from a specific gravity of 1.4 to 1.5. Debris on the other hand usually has a specific gravity of 2.0; therefore, it is relatively easy to separate the debris from the specific gravity; however, it is also obvious that the specific gravity of the magnetite must be controlled sufficiently to maintain its density less than that of the debris but more than that of the coal being mined. Most debris does have a specific gravity of 3.0; therefore, errors in the adjustment in the specific gravity would still not render the system inoperable but would merely provide less pure coal.

These and other modifications can be made to the embodiments illustrated and still be within the spirit and scope of the invention as described in the specification and appended claims.

We claim:

1. An apparatus for producing coal from a substantially vertical seam comprising:

means for forming a bore hole substantially vertical in said seam, said bore hole having a bottom;

fluid removal means in fluid communication with said bottom including means for anchoring said removal means at said bottom; coal dislodging means mounted in said bore hole for dislodging said coal a fixed distance from said bore hole;

means for enclosing the top of said bore hole having an outlet communicating therewith; fluid inlet means to said coal dislodging means;

means having a specific gravity greater than that of the coal for floating said coal dislodging by said dislodging means up to said means for enclosing the top of said bore hole and out of said outlet means; pump means; and means for connecting said pump means to said fluid removal means for extracting the fluid in said hole after said coal has been dislodged and production is completed.

2. An apparatus as described in claim 1 additionally including means for removing said means for floating said coal.

3. An apparatus as described in claim 2 wherein said means for removing comprises:

a first pipe having a length equal to the length of said bore hole and a plurality of openings at the bottom end of said pipe and wherein the means for dislodging said coal comprises a second pipe having a diameter larger than said first pipe mounted coaxially around said first pipe;

sealing means between said second pipe and said first pipe;

dislodging arm pivotally attached to the lower end of said second pipe; and means attached to said dislodging arm for engaging said coal surface and dislodging a portion of said surface.

4. An apparatus as described in claim 3 wherein said means for dislodging comprises a plurality of jets and means for maintaining said jets a predetermined distance from said coal surface.

5. An apparatus as described in claim 3 wherein said dislodging means comprises a plurality of coal picks.

6. An apparatus for producing coal from a substantially vertical seam having a substantially vertical bore hole formed therein comprising:

a first pipe having upper and lower ends, said lower end having a plurality of openings therethrough;

bore hole engaging means circumferentially attached about said lower end; a second pipe having an inner diameter larger than the outer diameter of said first pipe coaxially mounted around said first pipe, said second pipe having an upper and lower end;

rotatable sealing means mounted between the lower end of said second pipe and said first pipe;

coal dislodging means attached to the lower end of said second pipe;

slurry confining means having an inner diameter larger than the outer diameter of said second pipe and having a slurry outlet;

rotatable sealing means in said slurry outlet means mounted around said second pipe; means for rotating said second pipe with respect to said slurry confining means;

means connecting with said second pipe for moving said second pipe along its axis with respect to said first pipe; pump means; and means for connecting said pump means to said first pipe for extracting the fluid in said hole after said coal has been dislodged and production is completed.

7. An apparatus as described in claim 6 including a slurry coal separator having a slurry input connected to the slurry confining means and having a slurry outlet and a coal outlet and means connected between said slurry outlet and said second pipe for connecting said slurry to said second pipe.

8. An apparatus as described in claim 7 wherein said second pipe comprises a plurality of short sections secured at each end to form a continuous pipe.

9. An apparatus as described in claim 6 additionally including a pipe retaining means mounted above said slurry confining means for securing said pipe in a predetermined axial position with respect to said first pipe to permit removing excess lengths of pipe.

* * * * *

UNITED STATES PATENT OFFICE

CERTIFICATE OF CORRECTION

PATENT NO. : 3,993,146

DATED : November 23, 1976

INVENTOR(S) : William N. Poundstone et al

It is certified that error appears in the above-identified patent and that said Letters Patent are hereby corrected as shown below:

Column 7, line 10, "dislodging" should be --dislodged--.

Column 7, line 28, after "pipe" insert --and--.

Signed and Sealed this

Eighth Day of March 1977

[SEAL]

*Attest:*

RUTH C. MASON
*Attesting Officer*

C. MARSHALL DANN
*Commissioner of Patents and Trademarks*